US008607853B2

(12) United States Patent
Nelson et al.

(10) Patent No.: US 8,607,853 B2
(45) Date of Patent: Dec. 17, 2013

(54) MODULAR HEAT EXCHANGER CONNECTABLE IN MULTIPLE DIFFERENT CONFIGURATIONS

(75) Inventors: Wayne Nelson, Sheffield (GB); Jason Swift, Sheffield (GB); Glen Nelson, Sheffield (GB)

(73) Assignee: Modular Heat Exchangers Limited, Sheffield (GB)

( * ) Notice: Subject to any disclaimer, the term of this patent is extended or adjusted under 35 U.S.C. 154(b) by 1298 days.

(21) Appl. No.: 11/813,330

(22) PCT Filed: Jan. 5, 2006

(86) PCT No.: PCT/GB2006/000003

§ 371 (c)(1),
(2), (4) Date: Dec. 17, 2007

(87) PCT Pub. No.: WO2006/072774

PCT Pub. Date: Jul. 13, 2006

(65) Prior Publication Data

US 2008/0185123 A1 Aug. 7, 2008

(30) Foreign Application Priority Data

Jan. 6, 2005 (GB) ..... 0500103.7

(51) Int. Cl.
*F28F 9/02* (2006.01)
*F28D 1/02* (2006.01)

(52) U.S. Cl.
USPC ..... 165/175; 165/153

(58) Field of Classification Search
USPC ..... 165/175, 153
See application file for complete search history.

(56) References Cited

U.S. PATENT DOCUMENTS

| | | | | | |
|---|---|---|---|---|---|
| 1,385,450 | A | * | 7/1921 | Hildebrand | 165/130 |
| 1,731,575 | A | * | 10/1929 | Hyde | 62/524 |
| 1,737,251 | A | * | 11/1929 | Kuenstler | 165/130 |
| 1,797,636 | A | | 3/1931 | Butler | |
| 1,945,394 | A | * | 1/1934 | Carraway et al. | 165/137 |
| 1,948,149 | A | * | 2/1934 | Wentworth | 165/68 |
| 1,953,324 | A | * | 4/1934 | Wentworth | 165/130 |
| 1,962,837 | A | * | 6/1934 | Raible | 165/130 |
| 2,648,527 | A | * | 8/1953 | Carnahan | 165/167 |
| 3,499,484 | A | | 3/1970 | Lanzoni | 165/159 |
| 4,256,178 | A | * | 3/1981 | Fauvel | 165/165 |
| 4,969,512 | A | * | 11/1990 | Hisao et al. | 165/153 |
| 5,184,673 | A | * | 2/1993 | Hedman et al. | 165/153 |
| 5,303,770 | A | | 4/1994 | Dierbeck | 164/140 |

(Continued)

FOREIGN PATENT DOCUMENTS

| | | | |
|---|---|---|---|
| EP | 0 305 702 | 3/1989 | F28F 1/26 |
| EP | 0 324 266 | 7/1989 | C25C 7/06 |

(Continued)

*Primary Examiner* — Brandon M Rosati

(74) *Attorney, Agent, or Firm* — Harness, Dickey & Pierce, P.L.C.

(57) ABSTRACT

A heat exchanger modular unit (100) configured to be assembled with like units to form a heat exchanger. Each modular unit includes an elongate conduit (101) and connection means (102) configured to enable the modular units to be assembled together. Each elongate conduit (101) includes at least one internal bore through which a heat transfer fluid is capable of flowing. In particular, the connection means is formed non-integrally with the conduit enabling different materials to be used for both components. The conduit and connection means are bonded together using suitable bonding techniques.

27 Claims, 9 Drawing Sheets

(56) References Cited

U.S. PATENT DOCUMENTS

| | | | | |
|---|---|---|---|---|
| 5,896,916 | A * | 4/1999 | Baechner et al. | 165/78 |
| 6,032,728 | A * | 3/2000 | Ross et al. | 165/153 |
| 6,167,954 | B1 * | 1/2001 | Martins | 165/175 |
| 6,173,493 | B1 | 1/2001 | Dierbeck | 29/890.043 |
| 7,302,997 | B2 * | 12/2007 | Kozdras et al. | 165/67 |
| 2004/0244955 | A1 | 12/2004 | Laveran et al. | 165/166 |
| 2006/0196052 | A1 * | 9/2006 | Lesage | 29/890.043 |

FOREIGN PATENT DOCUMENTS

| | | | | |
|---|---|---|---|---|
| EP | 0 325 452 | | 7/1989 | F25B 39/02 |
| EP | 0 961 095 | | 12/1999 | F28D 1/053 |
| FR | 2122303 | A1 | 9/1972 | |
| FR | 2 536 525 | A1 | 5/1984 | |
| FR | 2 563 899 | | 11/1985 | F28D 1/04 |
| GB | 2 080 933 | | 2/1982 | F28F 1/14 |
| GB | 2 365 114 | | 7/2000 | F28F 9/26 |
| WO | WO95/18947 | | 7/1995 | F28D 1/02 |

* cited by examiner

MODULAR HEAT EXCHANGER CONNECTABLE IN MULTIPLE DIFFERENT CONFIGURATIONS

FIELD OF THE INVENTION

The present invention relates to heat exchangers, and in particular although not exclusively, to modular heat transfer units capable of being arranged together to construct a heat exchanger in which a heat transfer fluid is capable of flowing.

BACKGROUND TO THE PRIOR ART

Fluid to fluid heat exchangers find extensive use in both domestic and industrial applications and may be configured to provide a heating and/or a cooling effect as required.

Typically, a heat exchanger is constructed from a material of high thermal conductivity, in particular a metal, and comprises an internal chamber or network of chambers in which a heat transfer fluid is stored and allowed to flow. One example of a conventional heat exchanger is the domestic wall mounted radiator. In this example, water is heated by a remotely positioned boiler with the heated water then being transferred to the radiator via piping. The heated water then flows within the internal chamber(s) of the radiator transferring heat to the radiator body and ultimately the surrounding air.

Slightly more sophisticated heat exchangers operate under the same fluid to fluid heat transfer principle and are constructed from individual modular units which when assembled together form a single heat exchanger. Typical examples of modular heat exchangers are disclosed in U.S. Pat. Nos. 5,228,515, 4,742,866, 5,660,228, 5,392,848, 4,401,155, FR 2515805, EP 0252019 and EP 0239672.

Whilst known modular heat exchangers have a number of advantages including ease of transportation and installation prior to use, there are a number of significant disadvantages.

One problem with known modular heat exchangers is there limited construction versatility. Typically, the shape and size of the heat exchanger, constructed from the individual modular units, is limited. A further problem is the inherent difficulty in assembling the modular units to form the heat exchanger and subsequent full or partial dismantling when repair work is required.

A further significant problem with the construction of the heat exchanger from individual known modular units is the effectiveness of the heat exchanger to transfer heat, this being due to the non-optimised resulting heat exchanger shape and configuration.

U.S. Pat. No. 5,303,770 discloses a modular heat exchanger being formed from a plurality of elongate extruded aluminium blocks. Each module has a generally rectangular cross-section with a through bore extending between each end of the extruded block. Openings are provided at either end of each block such that when the modular units are stacked together the openings of neighbouring blocks are aligned providing internal fluid communication between the heat exchanger units.

GB 2365114 discloses a modular constructed radiator for a central heating system comprising a plurality of pipes and releasable push-fit coupling members configured to connect each pipe together to form a frame. Each push-fit coupling comprises at least two sockets, each having a pipe received therein and sealing means interposed between each-socket and the pipe to prevent egress of fluid from the frame via the coupling members.

Whilst the modular units of U.S. Pat. No. 5,303,770 and GB 2365114 provide for the construction of a modular heat exchanger, there is still a need for a modular unit that is more easily manufactured and in turn provides a stronger, more robust modular heat exchanger.

SUMMARY OF THE INVENTION

The inventors provide a heat exchanger and a heat exchanger modular unit capable of being assembled with other like units to form the heat exchanger. Connection means positioned adjacent an elongate conduit enable the heat exchanger to be assembled to a desired shape and size. Additionally, the connection means of one modular unit is configured to mate with connection means of a neighbouring modular unit so that when assembled together, the modular units are arranged in internal fluid communication with one another.

According to one aspect of the present invention there is provided a heat exchanger modular unit capable of being assembled with other heat exchanger modular units to form a heat exchanger, said modular unit comprising an elongate conduit having at least one longitudinally extending internal bore open at both ends; and connection means positioned at the open ends of said conduit to interconnect the internal bores of each conduit and enable said modular units to be connected together via each said connection means in internal fluid communication; said modular unit characterised in that each said connection means is formed non-integrally with said conduit and said connection means are bonded to said conduit.

Preferably, each modular unit is configured such that when assembled to form said heat exchanger, each conduit of each modular unit is spaced apart along its length from a neighbouring conduit in a plane extending substantially perpendicular to a plane extending along the length of each conduit. Accordingly the entire external surface area of each conduit is exposed to the surrounding fluid to maximise heat transfer.

Preferably, the modular unit comprises heat transfer fins extending over a region of the external surface of the conduit along its length. These heat transfer fins may be formed integrally or non-integrally with the conduit and may be formed on one or a plurality of each external face of the conduit.

Preferably, the connection means of each modular unit comprises a cavity wall dividing an internal cavity. The cavity wall has first and second orifices and an aperture positioned between the orifices.

Preferably, a slot is formed in the cavity wall extending from an external surface to an internal surface of the wall.

Preferably, the slot extends partially through the cavity wall on the external surface. Alternatively, the slot may be formed entirely through the cavity wall.

Preferably, the slot comprises a substantially uniform cross section.

Preferably, the cross section of the slot is stepped-down between the external surface and the internal surface to form an abutting surface for positioning in contact with an end portion of the conduit. At least one passageway may be formed within the cavity wall interconnecting a portion of the outer slot with the internal cavity so as to provide fluid communication between the internal bore of the conduit and the internal cavity.

Preferably, the connection means is configured to space apart the conduits, along their length, when assembled or connected together. In particular, a height or thickness of the connection means may be greater than a height or thickness of each conduit such that when stacked on top of one another, the connection means serve to both allow interconnection of the modular units and space apart the conduits. Additionally or alternatively, the connection means is provided with means to space apart the conduits when connected together, the means comprising at least one lip, ridge, tooth or projection being raised relative to the conduit. Accordingly, when assembled to form a heat exchanger, the modular units are configured to prevent the entire or a substantial part of the external surface of each conduit touching the external surface of an adjacent, neighbouring conduit.

The modular unit may comprise means to seal the fluid within the heat exchanger when assembled from the modular units. Optionally the means to seal is located in at least one groove formed by the lip. The means to seal may be formed as part of the connection means or formed non-integrally in the form of suitable sealing washes, gaskets, o-rings and the like as will be appreciated by those skilled in the art.

Preferably, the connection means comprises an annular configuration having a substantially circular cross section. Alternatively, the connection means may comprise a rectangular cross section. The circular or rectangular cross sections being in a plane aligned parallel with the length of the elongate conduit.

Alternatively, the modular unit comprises at least one detachable spacer configured for positioning between adjacent modular units so as to space apart each conduit when the modular units are assembled to form the heat exchanger.

Each conduit may comprise a single internal bore or a plurality of internal bores that may be interconnected or independent along their respective lengths. Additionally, the modular unit may comprise at least one fluid flow diverter positioned within the internal bore of the conduit and configured to divert the flow of fluid when flowing between the connection means positioned at either end. By increasing the fluid flow path within the conduit enhanced heat transfer is achieved.

The modular unit may comprise a single or a plurality of conduits positioned between two connection means located towards either end of the conduit(s). The conduits may be substantially straight or may comprise one or more curved regions.

The modular unit may be constructed from any conductive material, in particular a metal, a metal alloy and preferably aluminium. In particular, due to the modular construction of each modular unit, the conduit and the respective connection means may be formed from different materials. For example, the conduit may be formed from copper or a similar high thermal conductivity metal whilst the connection means may be formed from a harder metal such as aluminium or titanium.

According to a second aspect of the present invention there is provided a method of manufacturing a heat exchanger modular unit comprising forming an elongated conduit having at least one longitudinally extending internal bore open at both ends forming first and second connection means each having a cavity wall defining an internal cavity, said cavity wall having first and second orifices and an aperture positioned between said orifices and connecting each respective connection means at each open end of said conduit wherein each open end is in fluid communication with said internal cavity; said method characterised by bonding each connection means to each end of said conduit.

The connection means may be bonded to the conduit by welding, brazing, by thermally expanding the conduit within a portion of the connecting means and/or using a suitable adhesive. By housing a portion of the conduit within the slot formed within the connection means a strong and reliable couple between connection means and conduit is achieved due to the extended contact surface area between conduit and connection means within the region of the slot. In contrast to the prior art methods of manufacture the weld, braze or adhesive bonding material may be deposited within the slot so as to provide an extended bonding surface between conduit and connection means within the region of the slot. Bonding material may also be applied to the external periphery of the slot to increase the couple strength.

Preferably, the slot extends partially through the cavity wall between the external surface and the internal surface of the cavity wall. Alternatively, the slot may extend partially through the cavity wall requiring at least one additional passageway to be formed within the connection means so as to link the internal cavity and the slot terminating at some point between the external and internal surfaces.

According to a third aspect of the present invention there is provided a modular heat exchanger comprising a plurality of modular units, each unit having an elongate conduit with at least one longitudinally extending internal bore open at both ends; and each of said units having connection means positioned at the open ends of the conduit to interconnect the internal bores of each conduit and enable said modular units to be connected together via said connection means in internal fluid communication; said heat exchanger characterised in that each said connection means is formed non-integrally with said conduit and said connection means are bonded to said conduit.

Means are provided to enable the modular units to be secured together. In particular, each modular unit may comprise at least one hole configured to receive a securing member, in the form of a rod or pin capable of being threaded through each hole thereby securing the modular units in position. Alternatively, the modular units may be attached or secured together via a plurality of securing members extending between two plates abutting against modular units located at terminal positions within the assembled heat exchanger.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

A modular unit is provided configurable to be assembled into a heat exchanger enabling fluid to fluid heat transfer. The modular unit comprises at least one elongate conduit through which a fluid is capable of flowing. Means are provided towards each end of the elongate conduit to enable the modular units to be connected or assembled with neighbouring modular units to form the heat exchanger. Specifically, each modular unit is configured such that when positioned on top of one another to form the heat exchanger, the elongate conduits are spaced apart along their length from a respective, neighbouring conduit, the modular units being connected in internal fluid communication.

In particular, the thickness or height of each modular unit relative to the longitudinal axis of the unit may be greater towards the ends of the unit, at the regions where each modular unit is configured to contact an adjacent, neighbouring modular unit, with regard to a thickness or height of the conduit provided between the end contact regions. The effect of this difference in the relative thickness of the immediate conduit and the end regions is that when neighbouring, opposed modular units are positioned in contact with one another so as to touch towards each end of the respective end portions, the elongate conduits are spaced apart along their length.

Figure 1:
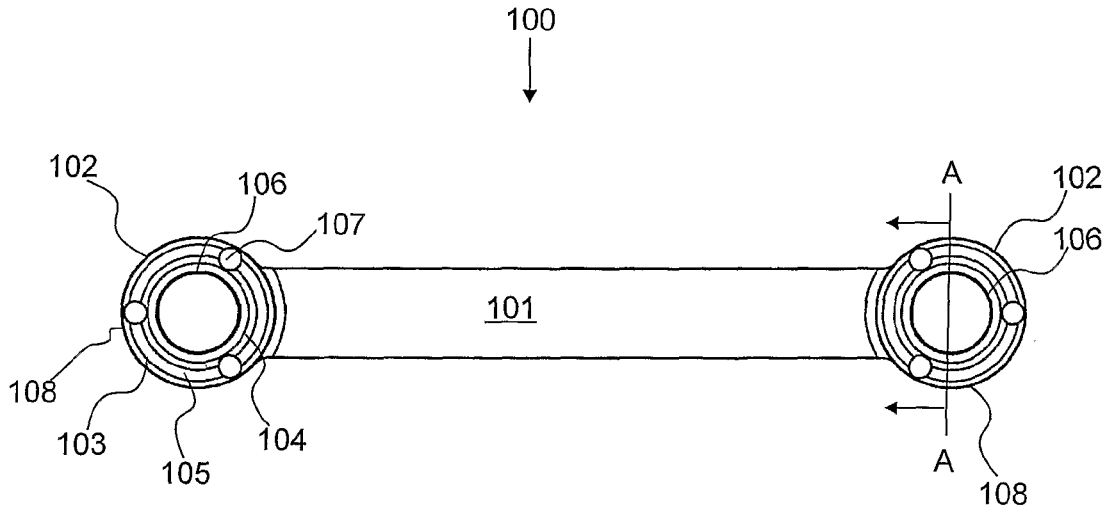
FIG. 1 herein is a plan view of a modular unit according to a specific implementation of the present invention.
Figure 2:
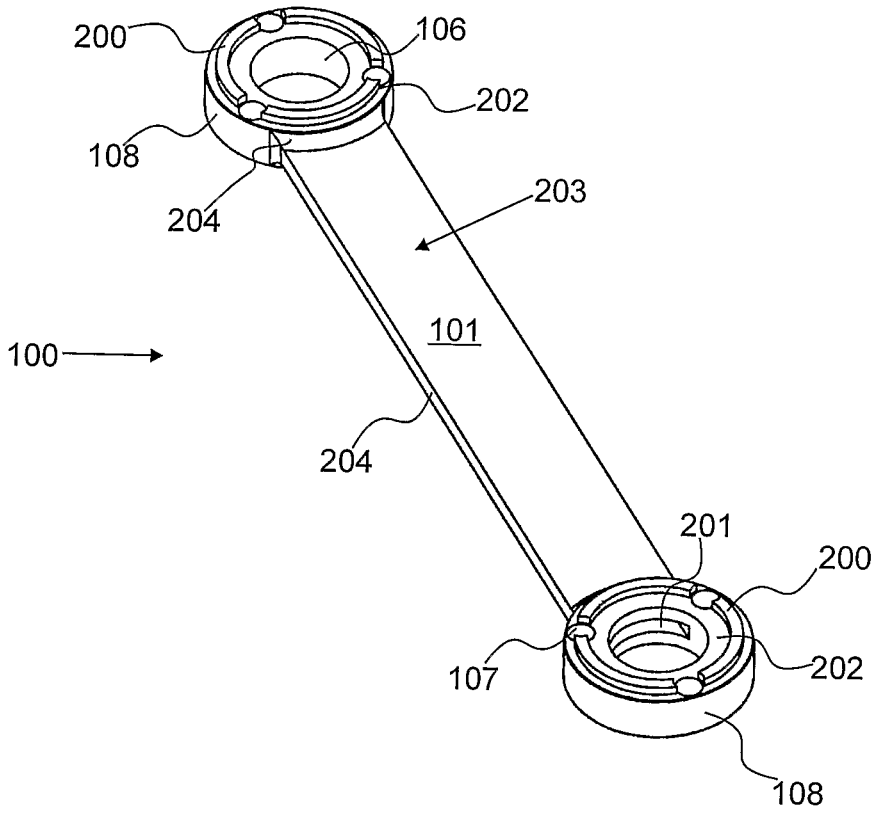
FIG. 2 herein is a perspective view of a slightly modified version of the modular unit of FIG. 1 herein.

FIG. 1 herein is a plan view of the modular unit 100 and FIG. 2 herein is a perspective view of a slightly modified version of the modular unit 100 of FIG. 1 herein.

The modular unit 100 comprises an elongate conduit 101 comprising a substantially rectangular cross section positioned between two connection means 102 provided at either end. Each connection means 102 is formed as an annular ring comprising an outer annular surface 108 and an inner annular surface 106. Elongate conduit 101 borders each connection means across a portion of the outer annular surface 108.

Referring to FIG. 1 herein each connection means comprises a first outer lip 103 formed on an upper surface of the connection means substantially perpendicular to annular surfaces 106, 108. A second inner lip is provided 104 so as to define a groove or channel 105 positioned between each outer and inner lip 103, 104, respectively. Each lip 103, 104 is substantially annular corresponding to the annular configuration of the connection means.

Referring to FIG. 2 herein each connection means comprises a single annular lip 200 being raised relative to an upper surface 202 of the connection means. Three equally spaced bore holes 107 are provided through each connection means extending from upper surface 202 to an adjacent lower surface (not shown). Each hole 107 intersects lip 103, 104 and 200 at three points along their respective annular paths.

As illustrated in FIG. 2 herein the elongate conduit 101, comprising a substantially rectangular cross sectional configuration, comprises an upper face 203 positioned adjacent a lower face (not shown) both faces being bonded along their length by faces 204. At least one internal channel extends the length of conduit 101. The channel terminates at the internal face 106 of the connection means in the form of an elongate aperture 201. Conduit 101 may be assembled with connection means using any conventional technique including in particular, brazing, welding or use of thermally conductive adhesive.

Figure 3:
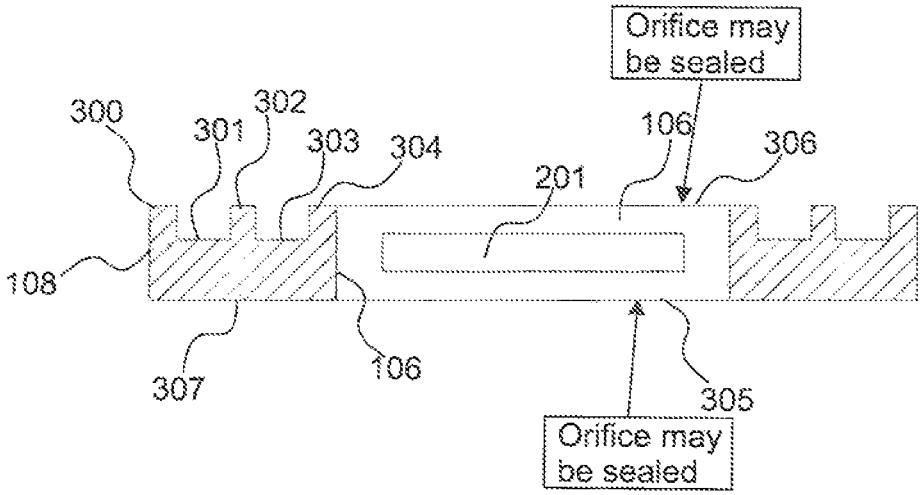
FIG. 3 herein is a cross sectional side elevation view of the end portions of the modular unit of FIG. 1 herein.

FIGS. 3 and 4 illustrate respectively a cross sectional side elevation view of the modular unit of FIG. 1 herein and a slightly modified version viewed along bisecting line A-A.

Referring to FIG. 3 herein annular grooves 301, 303 are defined by annular lips 300, 301, 304 provided at an upper surface of the connection means. At least one groove (not shown) may be formed at a lower surface 307 of the annular connection means being configured to mate with any one or a combination of lips 300, 302, 304 of an opposed modular unit enabling the connection means of neighbouring modular units to be nestled and seated together one on top of the other. In particular, any form of tongue and groove configuration may be utilised with the present invention configured to enable the connection means of neighbouring modular units to interconnect thereby correctly seating the modular units in position together.

The modular unit of FIG. 3 herein comprises a single channel extending along the length of conduit 101, a single aperture 201 being provided at either end of the elongate channel, aperture 201 being formed at internal annular surface 106. Alternatively and referring to FIG. 4 herein elongate conduit 101 comprises a plurality of channels extending along its length whereby a plurality of apertures 400 are formed at internal surface 106.

Each connection means comprises a first orifice 305 positioned adjacent a second orifice 306, the orifices being separated and defined by internal surface 106 so as to define an open ended short cylinder.

Figure 4A:
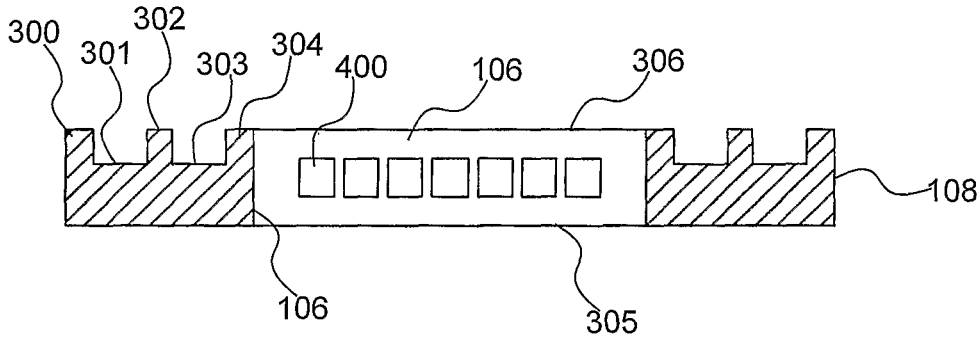
FIG. 4*a* herein is a cross sectional side elevation view of a modified version of the modular unit of FIG. 3 herein.
Figure 4B:
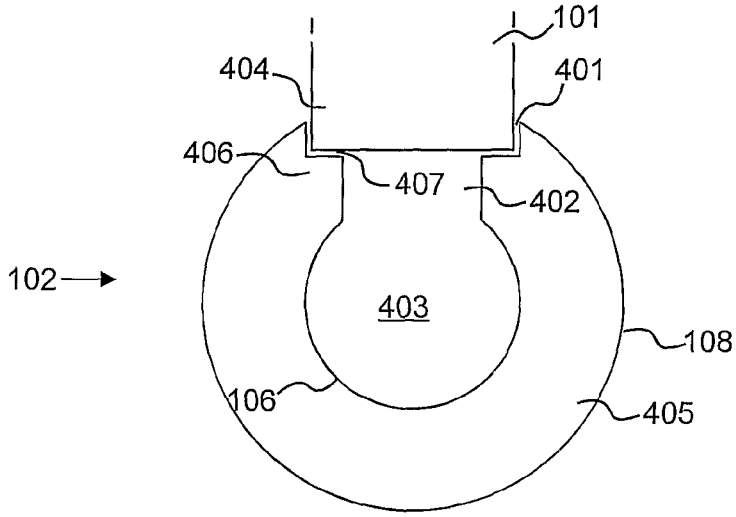
FIG. 4*b* herein is a cross sectional plan view of the assembly of the modular unit where an end portion of the conduit is inserted within a slot formed within the annular connection means.
Figure 4C:
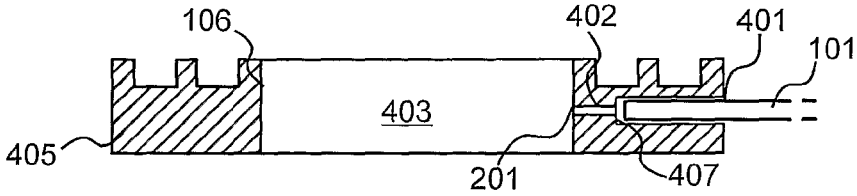
FIG. 4*c* herein is a cross sectional side elevation view of the modular unit of FIG. 4*b* herein.
Figure 4D:
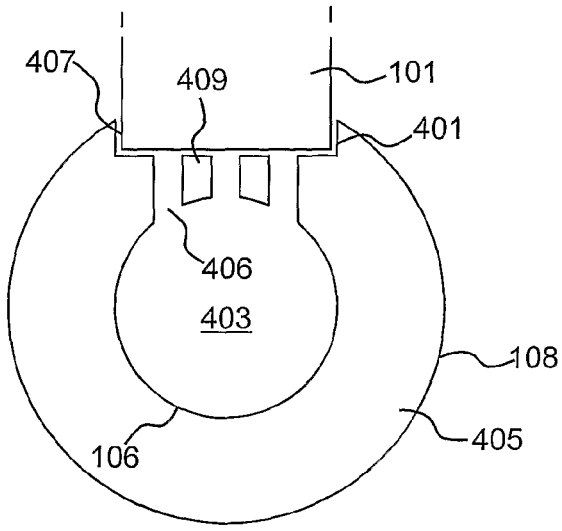
FIG. 4*d* herein is a cross sectional plan view of a further embodiment of the modular unit of FIG. 4*c* herein in which the internal cavity of the connection means is linked in fluid communication with the conduit via a plurality of passageways.

FIGS. 4*b* to 4*d* herein illustrate methods of construction of modular unit 100. Referring to FIG. 4*b* and 4*c* herein each connection means comprises a cavity wall 405 defining an internal cavity 403. The annular cavity wall, having external surface 108 and internal surface 106, comprises a slot 401 extending from external surface 108 towards internal surface 106. The cross sectional area of slot 401 is greater than the cross sectional of area of conduit 101 such that an end portion 404 of conduit 101 may be inserted and received within slot 401. The relative difference in the cross sectional area of slot 401 and conduit 101 is determined by the method used for bonding the conduit and the connection means together.

The rectangular slot 401 does not extend through the total thickness of cavity wall 405 and extends approximately halfway between external surface 108 and internal surface 106. A passageway or further slot 402 provides a link between internal cavity 403 and slot 401 so as to provide for internal fluid communication between the internal bore of conduit 101 and internal cavity 403. Accordingly, slot 401 terminates at an abutting surface 407 when conduit 101 is inserted within the slot 401 it abuts against surface 407.

According to further specific incrementations the notch 406 positioned between the abutting surface 407 and internal cavity 403 may be tapered inwardly towards the internal cavity 403 so as to match a tapered end profile of conduit 404.

FIG. 4*d* herein illustrates a slight variation on the construction of the connection means 102. A plurality of passageways 408 are provided between the abutting surface 407 and internal cavity 403 enabling fluid communication between the internal bore of conduit 101 and internal cavity 403. The passageways 402, 408 may be formed by drilling or extruding the cavity wall 405. The contact surface area between the end -face-of the conduit 101 and the connection means is extended relative to the embodiment of FIGS. 4*b* and 4*c* herein by the non-drilled or extruded cavity wall 409. This extended contact surface area increases the available bonding surface area between connection means 102 and conduit 101 in turn providing a stronger, more robust coupling.

The methods of bonding the connection means 102 at each end of conduit 101 include welding or brazing. Additionally, one or more adhesives may be used to secure conduit end portion 404 within slot 401. Further, the relative difference between the cross sectional area of slot 401 and conduit 101 may be tailored enabling the conduit to be secured to connection means 102 by thermally expanding end portion 404 within slot 401.

Figure 5:
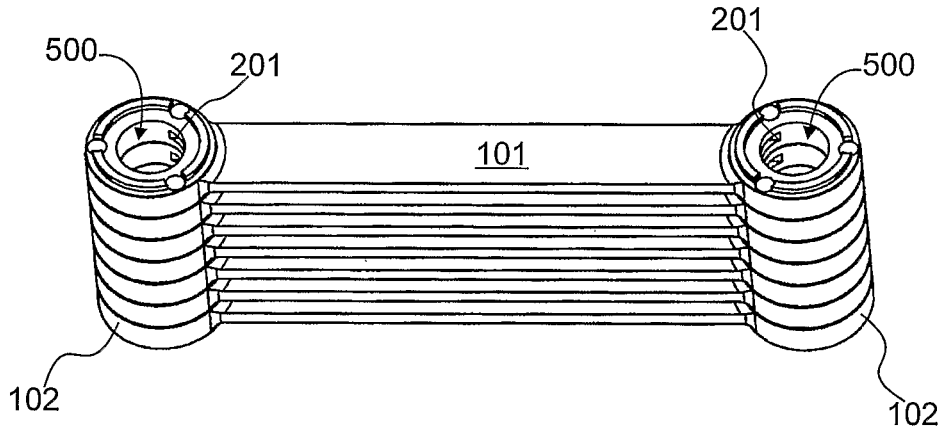
FIG. 5 herein is a perspective view of a plurality of modular units according to FIG. 2 herein connected together to form a heat exchanger.
Figure 6:
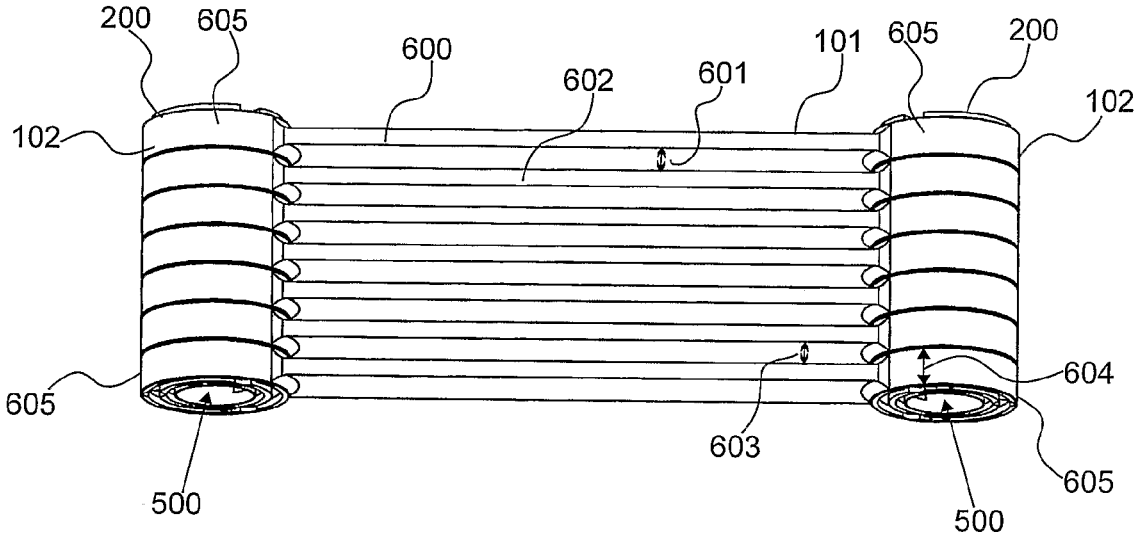
FIG. 6 herein is a side elevation view of the heat exchanger of FIG. 5 herein.

FIG. 5 herein illustrates a perspective view of a plurality of the modular units of FIG. 2 herein assembled together to form a heat exchanger. FIG. 6 herein illustrates a side elevation view of the heat exchanger of FIG. 5 herein. The connection means 102, comprising one or more lips and/or grooves formed on an upper and lower surface are configured to mate with neighbouring connection means enabling the modular units to be stacked one on top of another. Accordingly each elongate conduit 101 is positioned adjacent a neighbouring conduit when assembled as illustrated in FIGS. 5 and 6 herein. Due to the relative depth of elongate conduit 603 and connection means 604, each conduit is spaced apart from a neighbouring conduit in a plane extending substantially perpendicular to a plane extending along the length of each conduit by a distance 601.

According to further specific implementations of the present invention, spacer means may be provided between neighbouring modular units to space apart neighbouring conduits along their length as illustrated in FIGS. 5 and 6 herein. In such an embodiment, the depth of elongate conduit 603 may be substantially uniform along the length of the modular unit. The spacer means may be formed integrally or non-integrally with the modular unit.

When assembled to form the heat exchanger, each connection means is slotted together to define two fluid reservoirs 500 positioned at either end of the elongate conduits 101. Fluid reservoirs 500 are defined by internal annular surface 106. Suitable means to seal, in the form of sealing washers, o-rings and the like may be positioned between adjacent connection means, such means to seal optionally being seated within grooves 301, 303 and/or secured in place by one or more of the annular lips 103, 104, 200, 300, 302, 304 so as to prevent loss of fluid between adjacent modular units.

Figure 7:
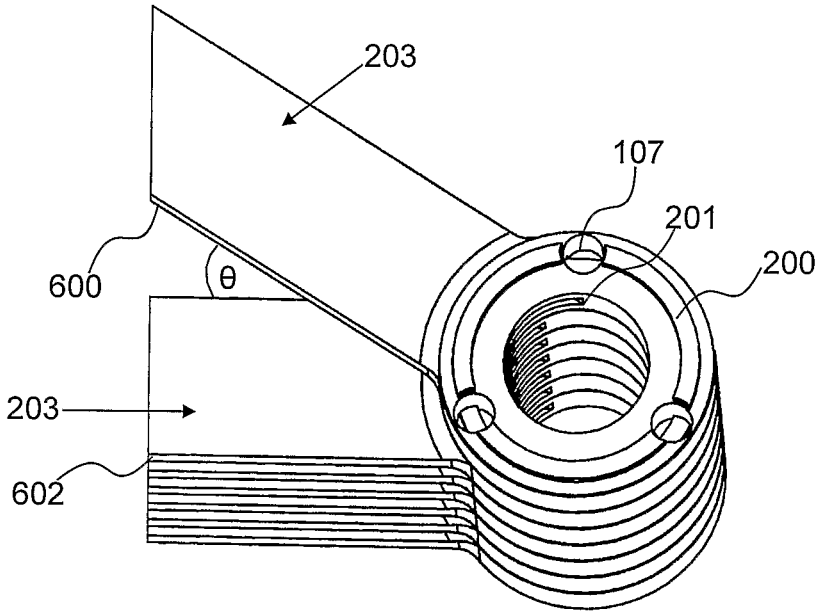
FIG. 7 herein is a perspective vie of a portion of the heat exchanger of FIG. 6 herein.

FIG. 7 herein illustrates a perspective view of the heat exchanger of FIGS. 5 to 6 herein in which one modular unit is positioned at an angle θ off-set relative to at least one neighbouring modular unit. Connection means 102 are configured such that θ is variable between 0° to 360° . Accordingly, the modular units of the present invention may be used to construct a heat exchanger of varying shape and size, whilst allowing a heat transfer fluid to flow freely between fluid reservoirs 500 via the single or plurality of internal channels extending along conduits 101.

Figure 8:
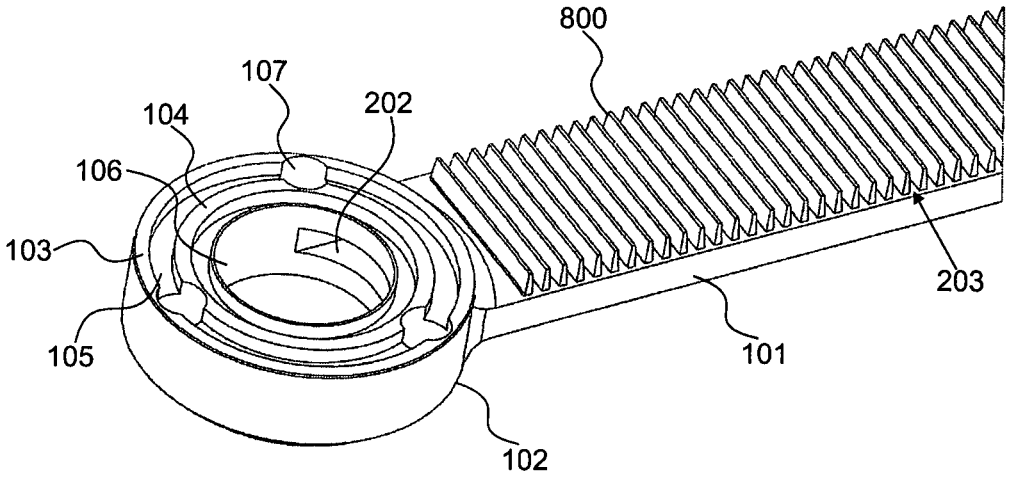
FIG. 8 herein is a perspective view of a portion of a modified version of the modular unit of FIG. 1 herein comprising a plurality of heat transfer fins according to a specific implementation of the present invention.

FIG. 8 herein is a perspective view of the modular unit of FIG. 1 herein further comprising heat transfer fins 800 extending along a portion of face 203 of conduit 101. Heat transfer fins 800 may be formed integrally or non-integrally with the elongate conduit and may be manufactured from a highly thermal conductive material in order to maximise fluid to fluid heat transfer.

Additionally, heat transfer fins 800 may be provided on each external face of conduit 101. In such an embodiment, the respective depth 603 and 604 of the conduit and connection means, or the depth of a suitable spacer, configured for positioning between adjacent modular units, is configured to ensure each conduit 101 is spaced apart, along its length, from neighbouring opposed conduits when connected together to form the heat exchanger. Fins 800 are configured to increase the external surface area of each modular unit to increase the fluid to fluid heat transfer effectiveness.

In use, the assembled heat exchanger may be connected, via suitable connection means known in the art, to a heat transfer fluid source, for example a water boiler or the like. In particular, the fluid supply piping may be connected to any one or a combination of outermost connection means 605 referring to FIG. 6 herein.

According to further specific implementations of the present invention, one or more of the orifices 305, 306 may be sealed to prevent passage of the heat transfer fluid through the orifice. A modular unit comprising one or more closed orifices (305, 306) may be used in an end position of the heat exchanger (605) or may be located at an intermediate position (602) within the heat exchanger whereby the sealed orifice (305, 306) is configured to divert the internal fluid flow.

According to further specific implementations, the cavity defined by the internal wall 106 of the connection means may be sub-divided into a plurality of sub-chambers using one or more internal walls spanning internal surface 106. Accordingly, when the modular units are assembled together, fluid reservoirs 500 may comprise a plurality of sub-reservoirs configured to house separately a plurality of heat transfer fluids, optionally being different heat transfer fluids. In such an embodiment the conduit would comprise a plurality of channels capable of providing independent flow paths for the segregated heat transfer fluids.

The heat exchanger of the present invention may be used in a plurality of applications including in particular, use as an air blast heat exchanger, for example a vehicle radiator, a domestic fluid to air wall mounted radiator, or a submerged heat exchanger, for example configured to provide a cooling effect for a transmission fluid of a vehicle operating with an automatic transmission as will be appreciated by those skilled in the art.

Depending upon the specific application of the heat exchanger, the modular units may be secured together by any suitable means, in particular the units may be compressed together by externally mounted tensioning rods or frame without requirement for bore holes 107.

The invention claimed is:

1. A heat exchanger modular unit (100) capable of being assembled with other heat exchanger modular units to form a heat exchanger of varying shape and size, said modular unit comprising: an elongate conduit (101) having at least one longitudinally extending internal bore open at both ends (201, 400); and connection means (102) formed non-integrally with and bonded to said conduit, positioned at the open ends of said conduit to interconnect the internal bores of each conduit and enable said modular units to be connected together via each said connection means in internal fluid communication; wherein each said connection means comprises an external surface (108), an internal surface (106) defining an internal cavity, an upper surface (202), a lower surface (307) and a plurality of bore holes (107) each extending from the upper surface to the lower surface and located between said external and internal surfaces, at least one lip (200) formed on the upper (202) surface and at least one groove (105) defined by first and second lips (103, 104) formed on the opposed lower (307) surface, wherein each bore hole (107) intersects the at least one lip (200) at the upper (202) surface and also the first and second lips (103, 104) at the lower (307) surface, the at least one lip (200) and the at least one groove (105) being configured to mate, respectively, with a corresponding groove and a corresponding lip of respective adjacent modular units (100) of the plurality thereof, for preventing fluid from egressing between adjacent connection means when said plurality of modular units are assembled together.

2. The modular unit as claimed in claim 1 wherein each modular unit is configured such that when assembled to form said heat exchanger, each conduit of each modular unit is spaced apart along its length from a neighbouring conduit in a plane extending substantially perpendicular to a plane extending along the length of each conduit.

3. The modular unit as claimed in claim 2 further comprising heat transfer fins (800) provided on an external surface (203) of said conduit.

4. The modular unit as claimed in claim 3 wherein said heat transfer fins are formed integrally with said conduit.

5. The modular unit as claimed in claim 3 wherein said heat transfer fins are formed non-integrally with said conduit.

6. The modular unit as claimed in any preceding claim wherein said internal surface comprises first and second orifices (305, 306) and an aperture (201) positioned between said orifices.

7. The modular unit as claimed in claim 6 comprising a cavity wall (405) defined by the external and internal surfaces (108, 106) and a slot (401) extending from said external surface towards said internal surface wherein said slot is configured to receive an end portion of said conduit.

8. The modular unit as claimed in claim 7 wherein said slot comprises a substantially uniform cross section between said external surface and said internal surface.

9. The modular unit as claimed in claim 7 wherein a cross section of said slot is stepped-down between said external surface and said internal surface to form an abutting surface (407) for positioning in contact with said conduit.

10. The modular unit as claimed in claim 7 wherein said slot extends partially through said cavity wall and said connection means further comprises at least one passageway (402, 408) interconnecting a portion of said slot with said internal cavity.

11. The modular unit as claimed in claim 1, wherein said means to seal comprises any one or a combination of the following set of:

a washer;

a gasket;

an O-ring.

12. The modular unit as claimed in claim 1, wherein said connection means comprises an annular configuration.

13. The modular unit as claimed in claim 1, wherein said conduit comprises a single internal bore.

14. The modular unit as claimed in claim 1, wherein said connection means is welded to said conduit.

15. The modular unit as claimed in claim 1, wherein said connection means is bonded to said conduit using an adhesive.

16. A modular heat exchanger comprising: a plurality of modular units (100), each unit having an elongate conduit (101) with at least one longitudinally extending internal bore open at both ends (201, 400); and each of said units having connection means (102) formed non-integrally with and bonded to said conduit, positioned at the open ends of the conduit to interconnect the internal bores of each conduit and enable said modular units to be connected together via said connection means in internal fluid communication; wherein each said connection means comprises an external surface (108), an internal surface (106) defining an internal cavity, an upper surface (202), a lower surface (307) and a plurality of bore holes (107), each extending from the upper surface to the lower surface and located between said external and internal surfaces, at least one lip (200) formed on the upper (202) or lower (307) surface and at least one groove defined by first and second lips (103, 104) formed, respectively, on the opposed lower (307) or upper (202) surface, wherein each bore hole (107) intersects the at least one lip (200) and also the first and second lips (103,104), the at least one lip (200) and the at least one groove (105) being configured to mate, respectively, with a corresponding groove and a corresponding lip of respective adjacent modular units (100) of the plurality thereof, for preventing fluid from egressing between adjacent connection means when said plurality of modular units are assembled together.

17. The heat exchanger as claimed in claim 16, further comprising heat transfer fins (800) positioned between said conduits.

18. The heat exchanger as claimed in claim 16 or 17, wherein said means to seal comprises any one or a combination of the following said of:

a washer;

a gasket;

an O-ring.

19. The heat exchanger as claimed in claim 16, wherein said connection means comprises a cavity wall (405) and a slot (401) extending from the external surface (108) of said cavity wall towards the internal surface (106) of said cavity wall, said slot being configured to receive an end portion (404) of said conduit.

20. The heat exchanger as claimed in claim 19, wherein each internal cavity is in fluid communication with each conduit.

21. The heat exchanger as claimed in claim 16, further comprising means to space apart each said conduit from a neighbouring said conduit along the length of each conduit in a plane extending substantially perpendicular to a plane extending along the length of each said conduit.

22. The heat exchanger as claimed in claim 21, wherein said means to space apart each said conduit is provided by a relative thickness of said connection means and a thickness of each said conduit along its length.

23. The heat exchanger as claimed in claim 16, wherein said conduit comprises a plurality of internal bores.

24. The modular unit as claimed in claim 1, wherein said conduit comprises a plurality of internal bores.

25. The modular unit as claimed in claim 1, wherein said connection means is bonded to said conduit by thermally expanding a portion of said conduit within said connection means.

26. The modular unit as claimed in claim 1, wherein said connection means is bonded to said conduit by brazing.

27. The modular unit as claimed in claim 1, wherein the plurality of bore holes comprises three or more bore holes.

* * * * *